US007758357B2

(12) United States Patent
Pan et al.

(10) Patent No.: US 7,758,357 B2
(45) Date of Patent: Jul. 20, 2010

(54) RECEPTACLE BACKPLANE CONNECTOR HAVING INTERFACE MATING WITH PLUG CONNECTORS HAVING DIFFERENT PITCH ARRANGEMENT

(75) Inventors: Feng Pan, Kunshan (CN); Chih-Ming Chien, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/629,091

(22) Filed: Dec. 2, 2009

(65) Prior Publication Data

US 2010/0136844 A1 Jun. 3, 2010

(30) Foreign Application Priority Data

Dec. 2, 2008 (CN) ..... 200820303048
Dec. 2, 2008 (CN) ..... 200820303050

(51) Int. Cl.
*H01R 4/66* (2006.01)

(52) U.S. Cl. ..... 439/108; 439/607.07; 439/701

(58) Field of Classification Search ..... 439/108, 439/701, 607.07
See application file for complete search history.

(56) References Cited

U.S. PATENT DOCUMENTS 6,652,318 B1 11/2003 Winings et al.
6,913,490 B2 * 7/2005 Whiteman et al. ..... 439/108
7,118,391 B2 10/2006 Minich et al.

* cited by examiner

*Primary Examiner*—Tho D Ta
(74) *Attorney, Agent, or Firm*—Ming Chieh Chang; Wei Te Chung; Andrew C. Cheng

(57) ABSTRACT

The electrical connector (100) includes a front housing (20) and a number of stacked wafers 40 assembled to the front housing (20). The front housing (20) defines a number of passageways (202) arranged in rows and columns. Each of the wafers includes a lead frame (34) and nine contacts (41-49) molded in the lead frame (34). Each of the contacts (41-49) further includes a fastening portion (404) molded in the lead frame (34), a mating portion (408) extending from an end of the fastening portion (404) for mating with a complementary mating connector (600) and a terminal portion (406) extending from an opposite end of the fastening portion (404) to be mounted in said PCB. The nine conductive contacts (41-49) are arranged on a coplanar surface. Adjacent rows of passageways (202) are arranged with a slight offset. Corresponding adjacent wafers 40 are arranged with the contacts of adjacent wafers (40) aligned in a direction perpendicular to the coplanar surface.

19 Claims, 15 Drawing Sheets

RECEPTACLE BACKPLANE CONNECTOR HAVING INTERFACE MATING WITH PLUG CONNECTORS HAVING DIFFERENT PITCH ARRANGEMENT

BACKGROUND OF THE INVENTION

1. Field of the Invention

The present invention relates to a backplane connector, and more particularly to a receptacle backplane connector having a universal passageway capable of mating with plug connector with different interfaces.

2. Description of Related Art

U.S. Pat. No. 7,118,391, issued to Minich et al on Oct. 10, 2006, discloses an electrical connector having a lead frame housing, a first electrical contact fixed in the lead frame housing, a second electrical contact fixed adjacent to the first electrical contact in the lead frame housing, and a third electrical contact fixed adjacent to the second electrical contact in the lead frame housing. Each of the first and second electrical contacts may be selectively designated, while securely fixed in the lead frame housing, as either a ground contact or a signal contact such that, in a first designation, the first and second contacts form jointly configure a differential signal pair, and, in a second designation, the second contact is a single-ended signal conductor. The third electrical contact may be designated as a ground contact having a terminal end that extends beyond terminal ends of the first and second contacts.

U.S. Pat. No. 6,652,318, issued to Winings et al on Nov. 25, 2003, discloses a high speed electrical connector configured, theoretically and ideally, to reduce the incidence of cross-talk. The connector includes a connector housing and a plurality of columns of differential contact pairs and ground contacts. Each column of differential contact pairs and ground contacts is offset from an adjacent column, i.e. lower or higher than the adjacent column a small amount of distance from vertical direction, such that multi-active cross-talk is theoretically and ideally reduced with respect to each differential contact pair.

However, the Wingings connector can only mate with its own family, i.e. plug and receptacle connectors with offset arrangement. This offset arrangement inevitably prevents it from mating with a connector system without offset system. This will create a great deal of inconvenience. For example, if the existing system is a non-offset connector system, then the customer has to keep on using it, and vise versa.

Additionally, the Minch connector has a plurality of lead frame housings stacked together and accordingly a plurality columns of contacts arranged within the lead frame housings. The contacts in the lead frame housings have different contact designations and so the complementary mating connector has to have the lead frame assemblies with different configurations accordingly, which inevitably increases the manufacturing cost.

Accordingly, a connector system which can mate with either offset or non-offset system is highly desired for the market in view of cost-down trend.

SUMMARY OF THE INVENTION

Hence, an object of the present invention is to provide a high-speed electrical connector which can mate with either offset or non-offset system.

An electrical connector to be mounted on a PCB is provided. The electrical connector comprises a front housing and a plurality of stacked wafers assembled to the front housing.

The front housing defines a front surface, an opposite back surface and a plurality of passageways extending from said back surface to said front surface, the passageways being arranged in an array comprising rows and columns. Each of the wafers comprises a lead frame and a plurality of conductive contacts molded in the lead frame. Each of the contacts further comprises a fastening portion molded in the lead frame, a mating portion extending from an end of the fastening portion for mating with a complementary mating connector and a terminal portion extending from an opposite end to be mounted in said PCB. The plurality of conductive contacts are arranged coplanarly. The mating portions of the contacts of a wafer are respectively inserted into a row of passageways. Adjacent rows of passageways are arranged with an offset, which will be detailedly described later. Corresponding adjacent wafers are arranged with the contacts of adjacent wafers aligned in a direction perpendicular to the coplanar surface. Therefore, the high-speed connector could be designed with contact wafers in a same configuration while kept matable to a mating connector having offset-contact array or non-offset-contact array.

According to another aspect of the present invention, another high-speed electrical connector is provided. The electrical connector comprises a front housing and a plurality of stacked wafers assembled to the front housing. The front housing defines a front surface, an opposite back surface and a plurality of passageways extending between the frond and rear surfaces, and arranged in an array. Each of the wafers comprises a lead frame and a plurality of conductive contacts molded in the lead frame. Each of the contacts further comprises a fastening portion molded in the lead frame, a mating portion extending from an end of the fastening portion for mating with a complementary mating connector and a terminal portion extending from an opposite end to be mounted in said PCB. The plurality of conductive contacts are arranged coplanarly. The mating portions of the contacts of a wafer are respectively inserted into a row of passageways. The lead frame of each wafer forms a front edge and a notch therein, the mating portions of two adjacent contacts of the wafer extending forwardly from the notch and the mating portions of the other contacts extending forwardly from the front edge of the lead frame. The wafers of high-speed electrical connector can be designed with a same configuration while kept matable to a complementary mating connector having different ground contact arrangements in adjacent lead frame assembly.

Other objects, advantages and novel features of the invention will become more apparent from the following detailed description of a preferred embodiment when taken in conjunction with the accompanying drawings.

DETAILED DESCRIPTION OF THE INVENTION

Figure 1:
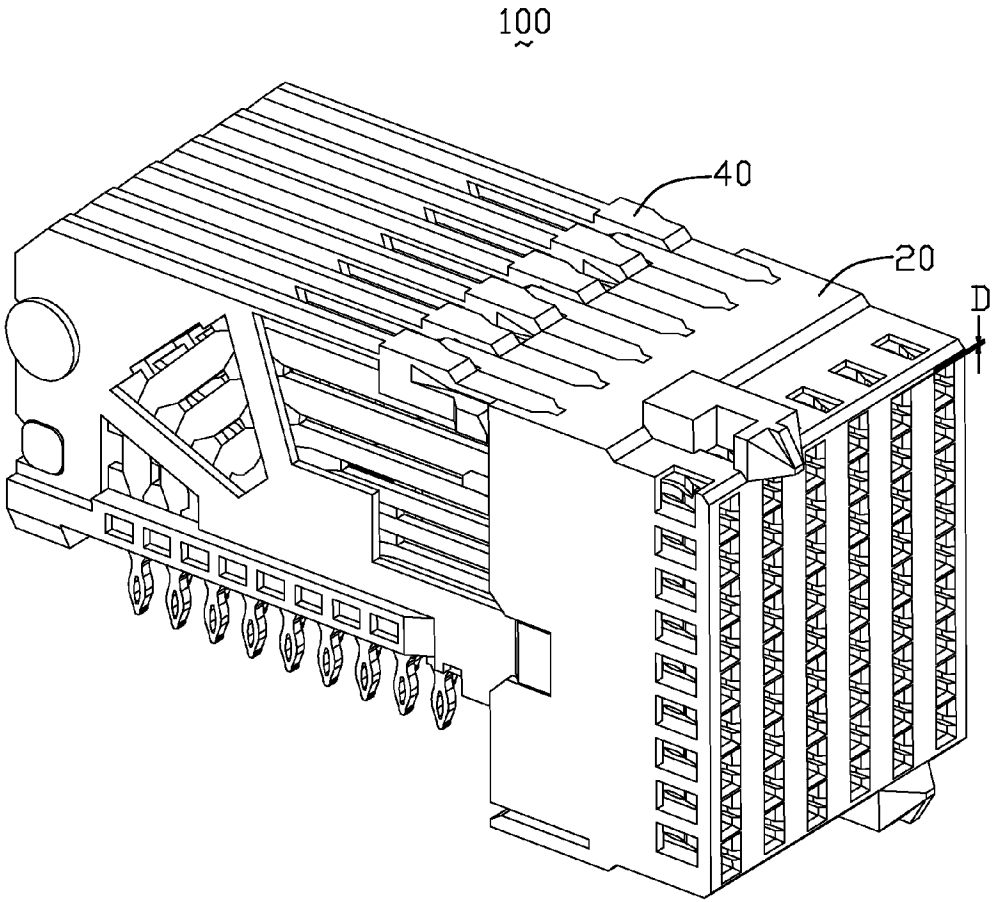
FIG. 1 is a perspective view of an electrical connector according to the present invention.

Reference will now be made to the drawing figures to describe the present invention in detail.

Referring to FIGS. 1-7, a high-speed electrical connector 100 made according to an embodiment of the present invention is shown. The electrical connector 100 is mounted on a PCB.

The electrical connector 100 comprises a front housing 20 and a plurality of wafers 40 stacked and assembled within the front housing 20. The front housing 20 defines a front surface 204, an opposite back surface 206 and a plurality of passageways 202, 203 extending from said back surface 206 to said front surface 204 and arranged in array comprising of rows and columns. Each of the wafers comprises a lead frame 34 and nine conductive contacts 41-49 molded in the lead frame 34. Each of the contacts 41-49 further comprises a fastening portion 404 molded in the lead frame 34, a mating portion 408 extending from an end of the fastening portion 404 for mating with complementary mating connectors 600, 600' (shown in FIGS. 8-11) and a terminal portion 406 extending from an opposite end of the fastening portion 404 to be mounted in said PCB. The nine conductive contacts 41-49 are arranged coplanarly, which in turn are respectively designated from the first to the ninth conductive contacts 41-49. The mating portions 408 of the conductive contacts 41-49 of each wafer 40 are respectively inserted into a row of passageways 202. The array of the passageways 202 are arranged in a way such that every two adjacent columns, as seen from vertical direction, is offset from each other, or higher or lower, in a predetermined distance D. While, the contacts 41-49 of each wafer 40 are aligned to corresponding contacts 41-49 of an adjacent wafer 40 in a direction perpendicular to the coplanar surface, which is clearly shown in FIG. 7.

Figure 8:
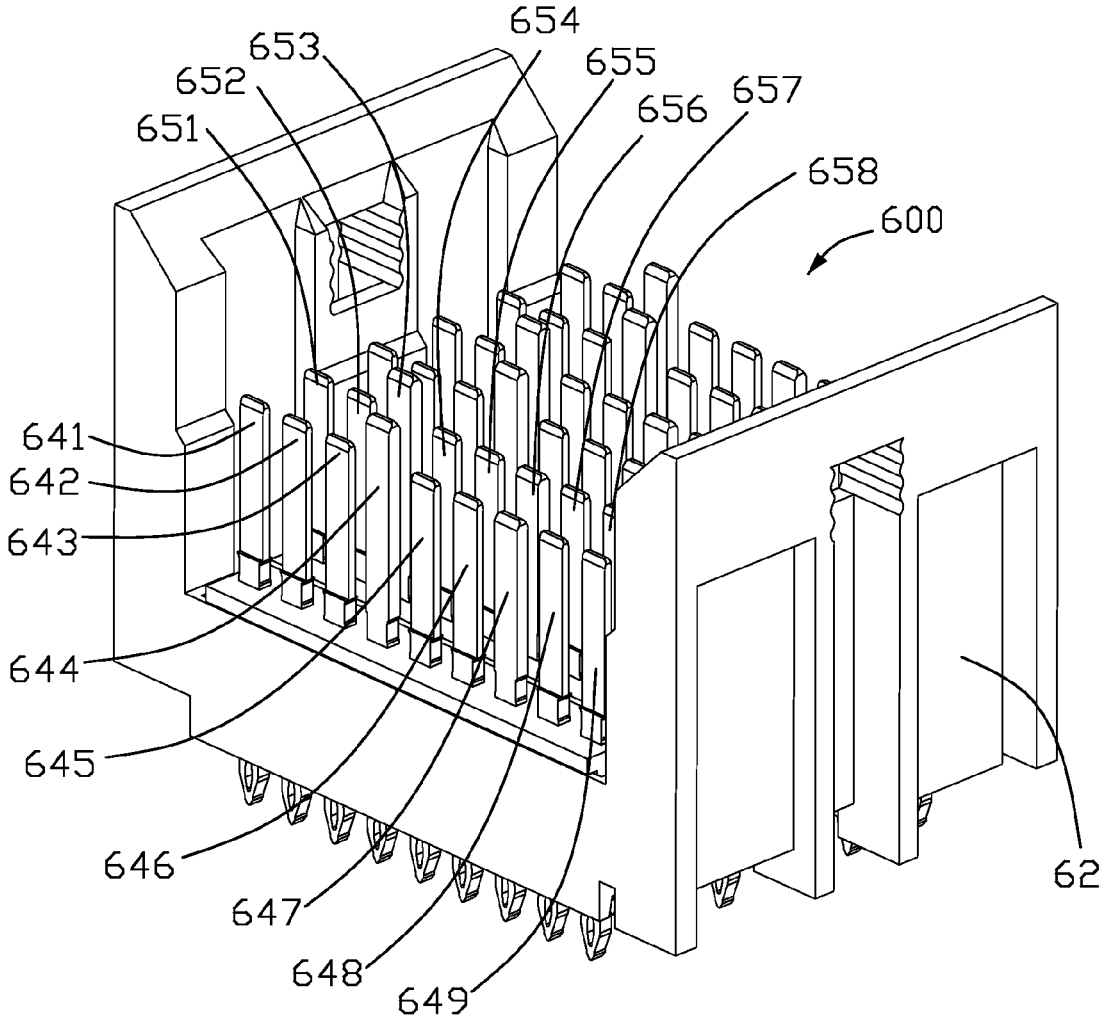
FIG. 8 is a perspective view of a complementary mating connector having non-offset contact array.
Figure 9:
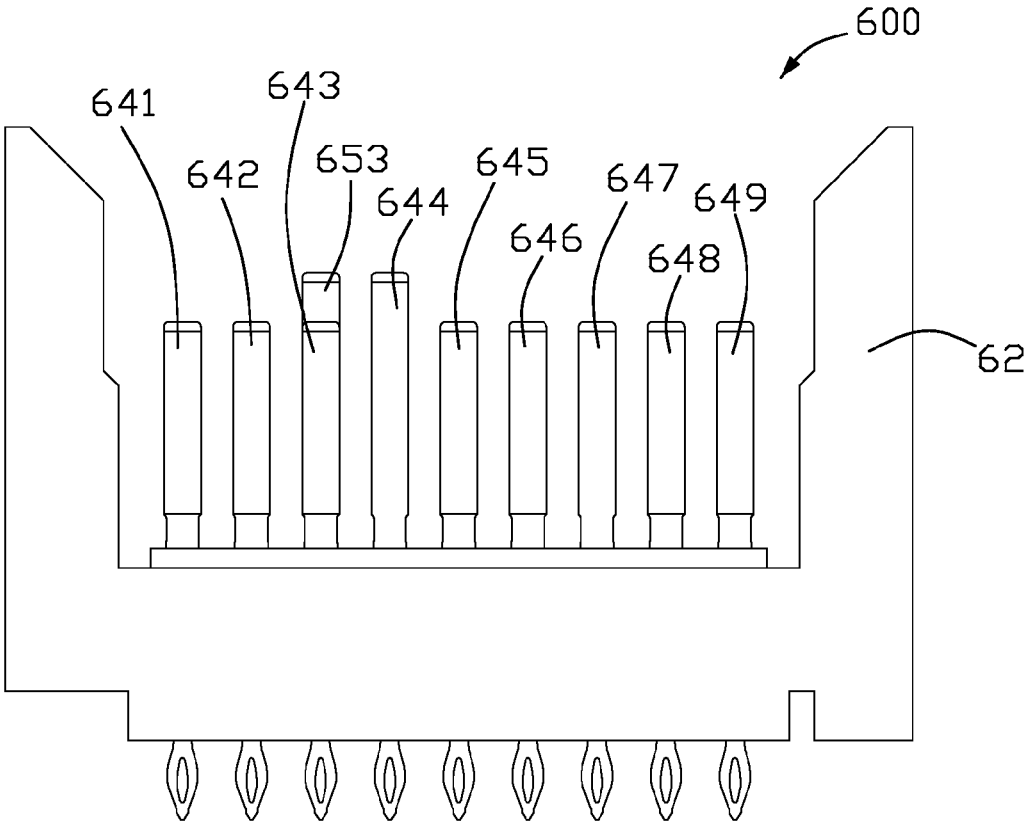
FIG. 9 is a side view of the complementary mating connector shown in FIG. 8.
Figure 10:
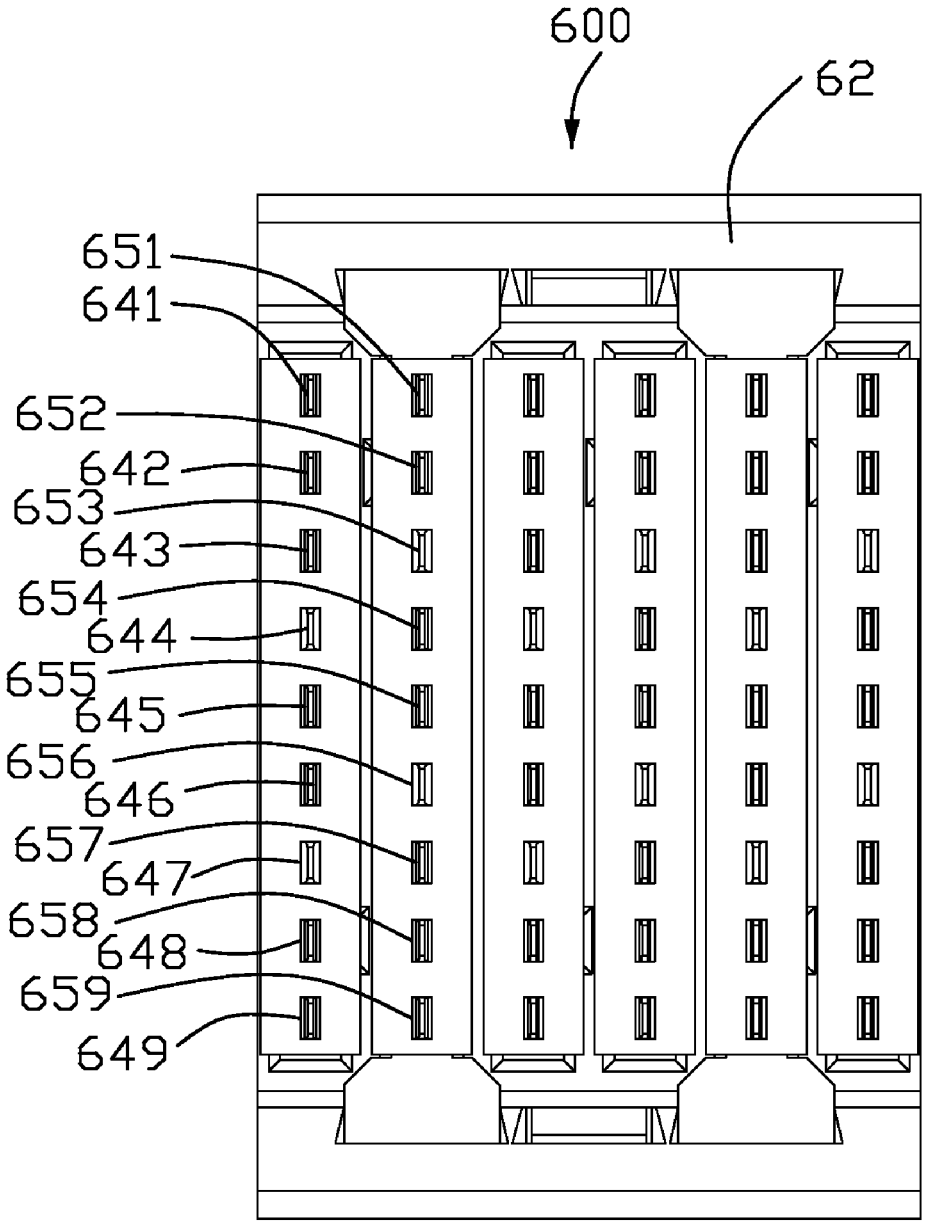
FIG. 10 is a top view of the complementary mating connector shown in FIG. 8.

Referring to FIGS. 8-10, a first complementary mating connector 600 having non-offset contact array is shown. The mating connector 600 comprises a housing 62 and columns of mating contacts 641-649, 651-659 fastened to the housing 62. Each column of mating contacts has nine mating contacts 641-649 for mating with a corresponding column of passageways 202 of the front housing 20 and then engaged with the mating portions 408 of corresponding conductive contacts 41-49. The column of the mating contacts 641-649 is again arranged in turn from a first to a ninth contacts: signal contact pair 641, 642, ground contact 643, signal contact pair 644, 645, ground contact 646, signal contact pair 647, 648, ground contact 649, among which the fourth contact 644 is longer than the others 641-643, 645-649. An adjacent column of the mating contacts 651-659 is arranged in turn from a first to a ninth contacts: ground contact 651, signal contact pair 652, 653, ground contact 654, signal contact pair 655, 656, ground contact 657, signal contact pair 658, 659, among which the third contact 653 is longer than the others 651, 652, 654-659.

Figure 11:
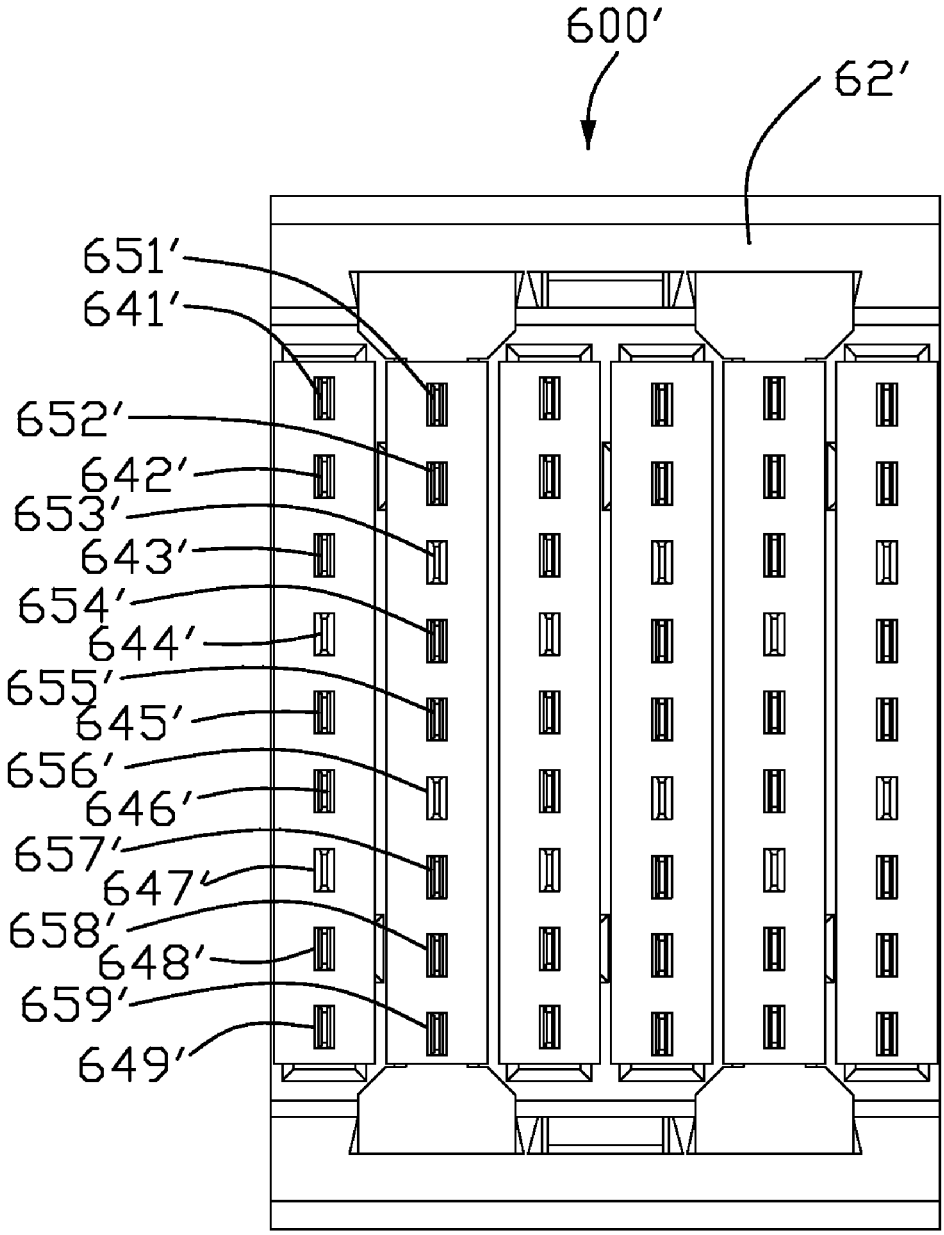
FIG. 11 is a top view of another complementary mating connector having offset contact array.

Referring to FIG. 11, a second complementary mating connector 600' having an insulative housing 62' with offset-arranged contact array therein is shown. The second mating connector 600' is similar to the first mating connector 600 except that every two adjacent columns of contacts are offset with a distance D, i.e. higher or lower than the adjacent column contact from vertical direction.

Figure 12:
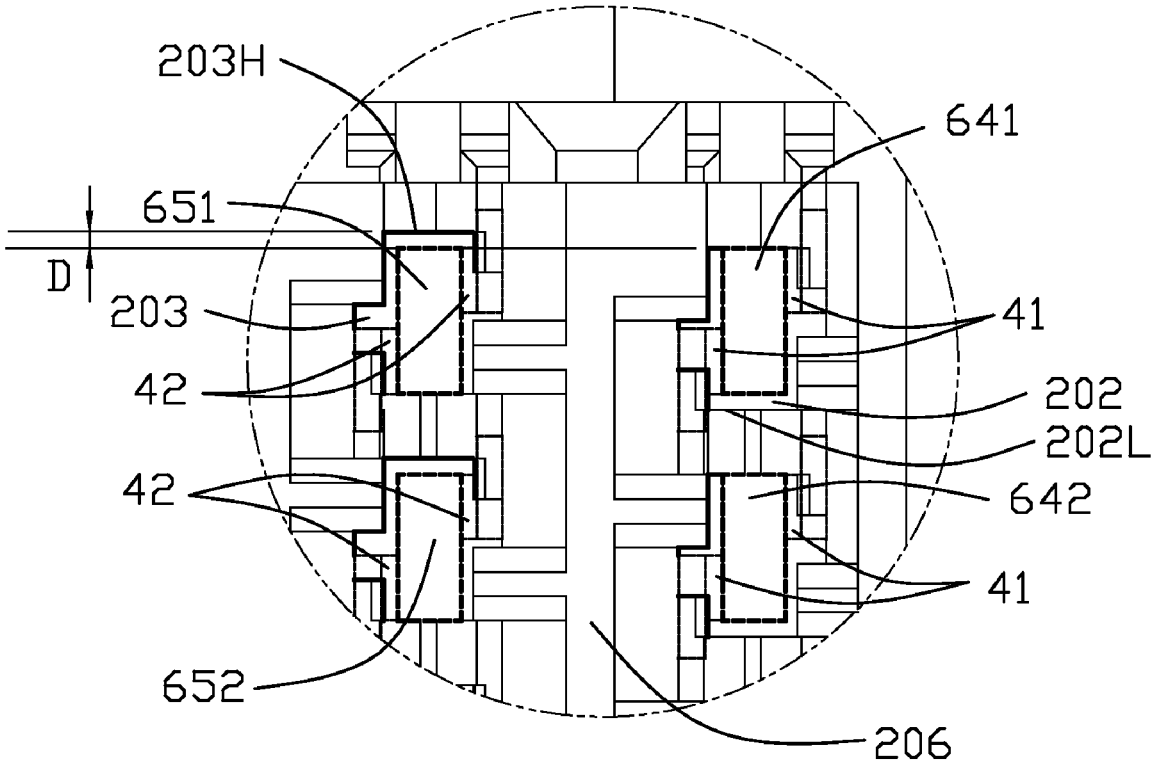
FIGS. 12 and 13 are enlarged views showing circled portion of the front housing shown in FIG. 6, wherein the contacts of the electrical connector are shown in regular dotted line and the mating contacts of a complementary connector having non-offset contact array are briefly shown in bold dotted line in FIG. 12, wherein the contacts of the electrical connector are shown in regular dotted line and the mating contacts of a complementary connector having offset contact array are briefly show in bold dotted line in FIG. 13, and wherein half of the profile of the passageways is shown in thick solid line.
Figure 13:
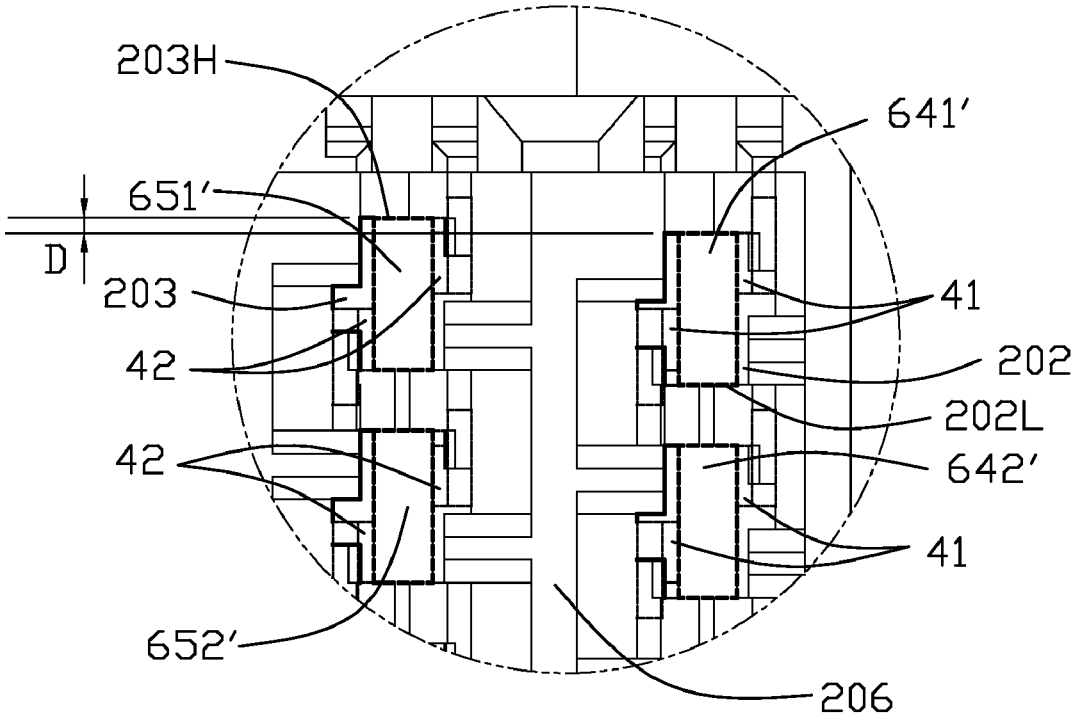

Referring to FIGS. 12 and 13, adjacent rows of passageways 202, 203 are arranged with the preset offset D so that the electrical connector 100 is interchangeably mated with both the first complementary connector 600 shown in FIGS. 8-10 and the second complementary connector 600' shown in FIG. 11. Every two adjacent passageways 202, 203 are offset from each other with the preset distance D, such a first passageway 202 has a lowest point 202L, while the second passageways 203 has a highest point 203H. When the first complementary connector 600 is mated with the receptacle connector 100, the highest point 203H and lowest point 202L of the passageways 202, 203 are not substantially in contact with the header contacts 641-649, 651-659. When the first complementary connector 600' is mated with the receptacle connector 100, the highest point 203H and the lowest point 202L of the passageways are substantially in contact with the first and second header contacts 641-649, 651-659.

Figure 2:
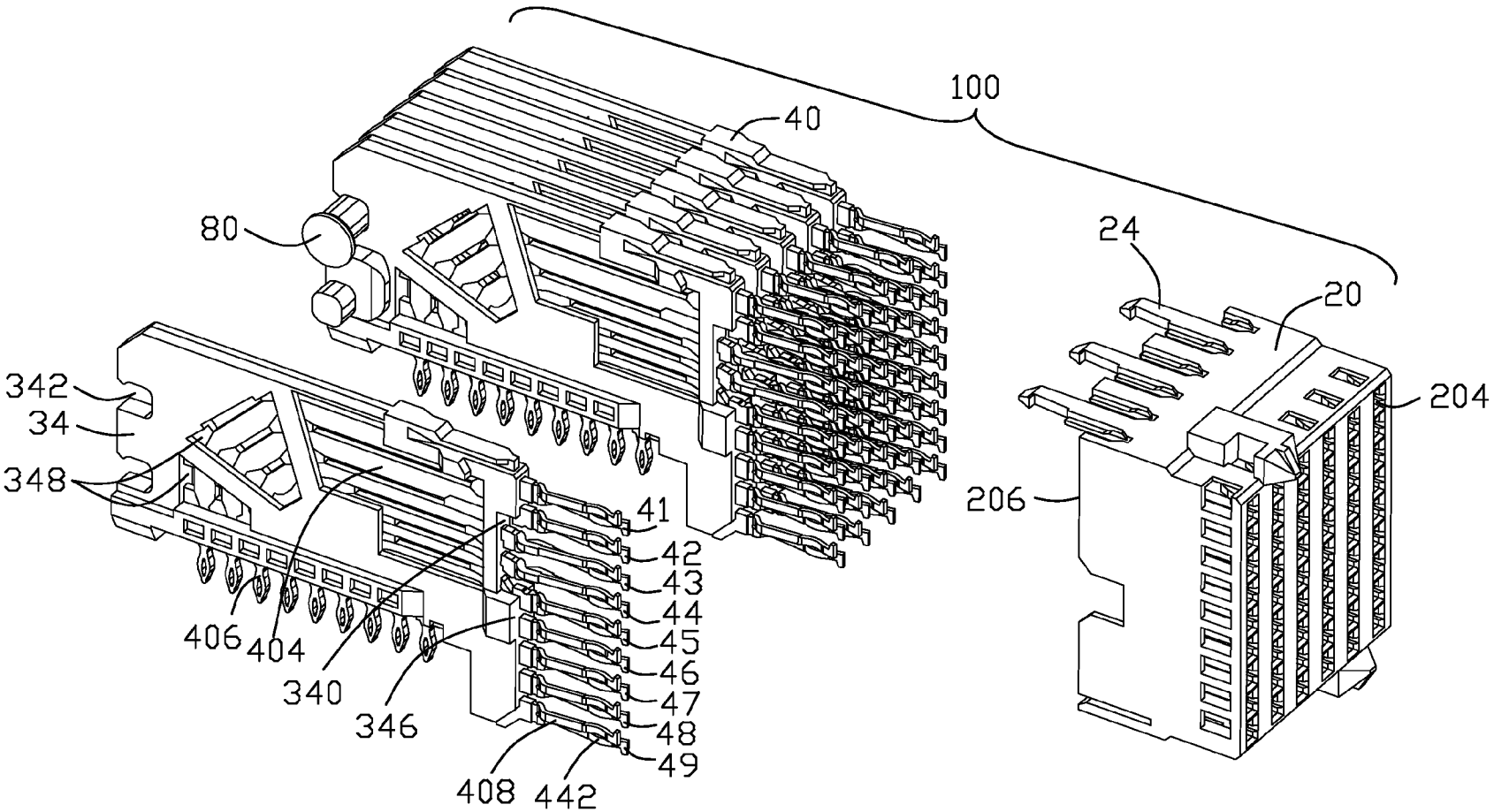
FIG. 2 is a partially exploded view of the electrical connector shown in FIG. 1.
Figure 3:
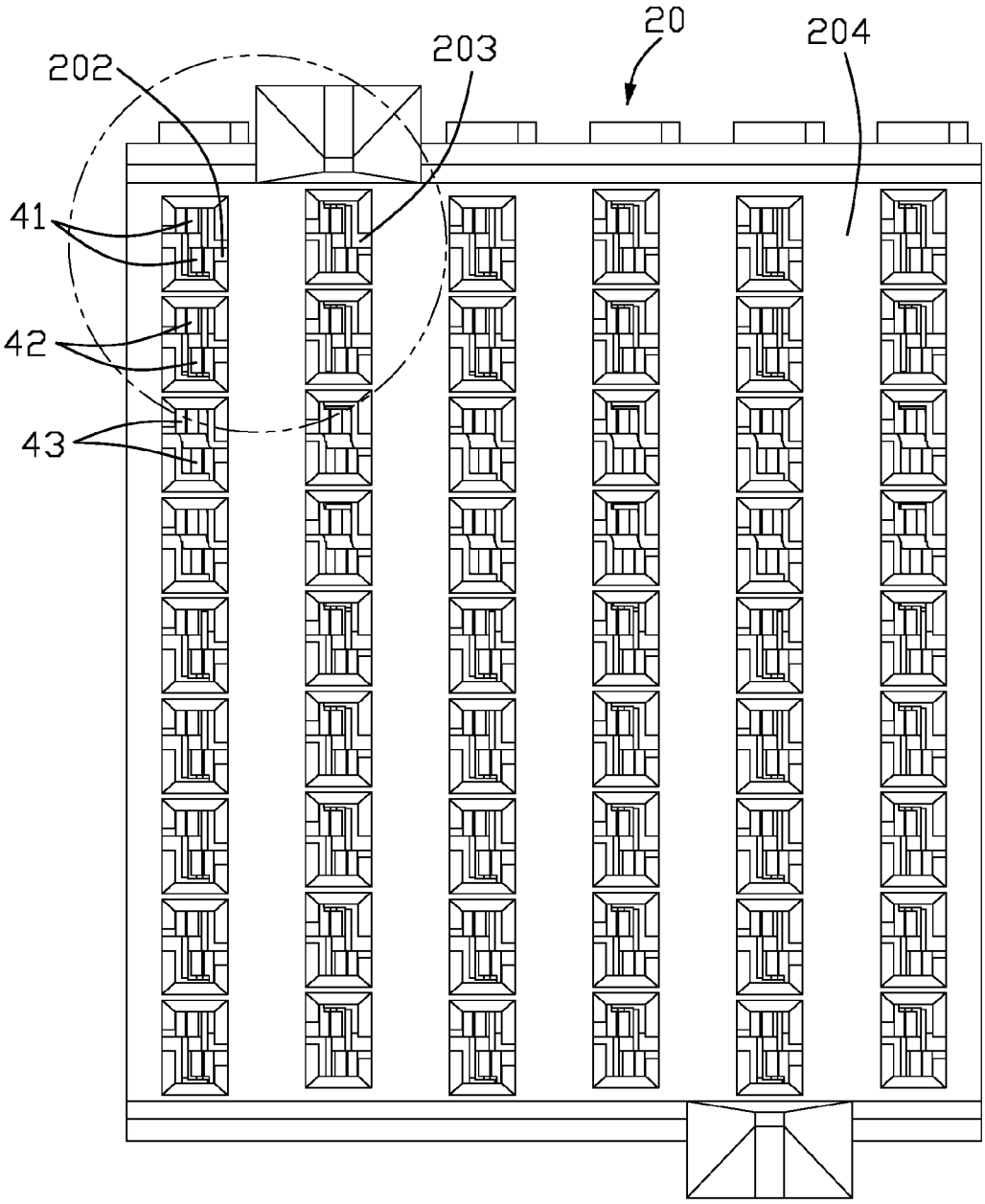
FIG. 3 is a front view of the electrical connector shown in FIG. 1.
Figure 4:
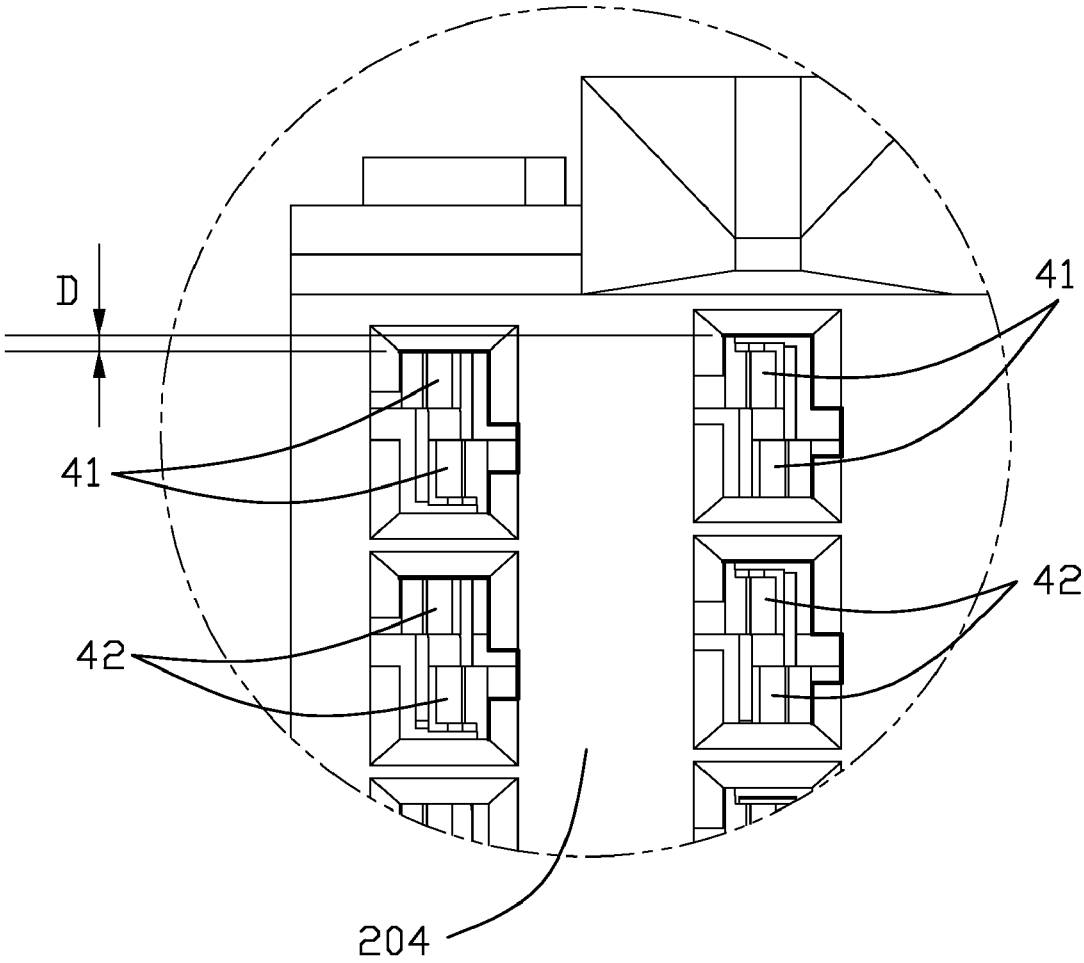
FIG. 4 is an enlarged view of a circled portion of the electrical connector shown in FIG. 3, wherein half of the profile of the passageways is shown in thick solid line.
Figure 5:
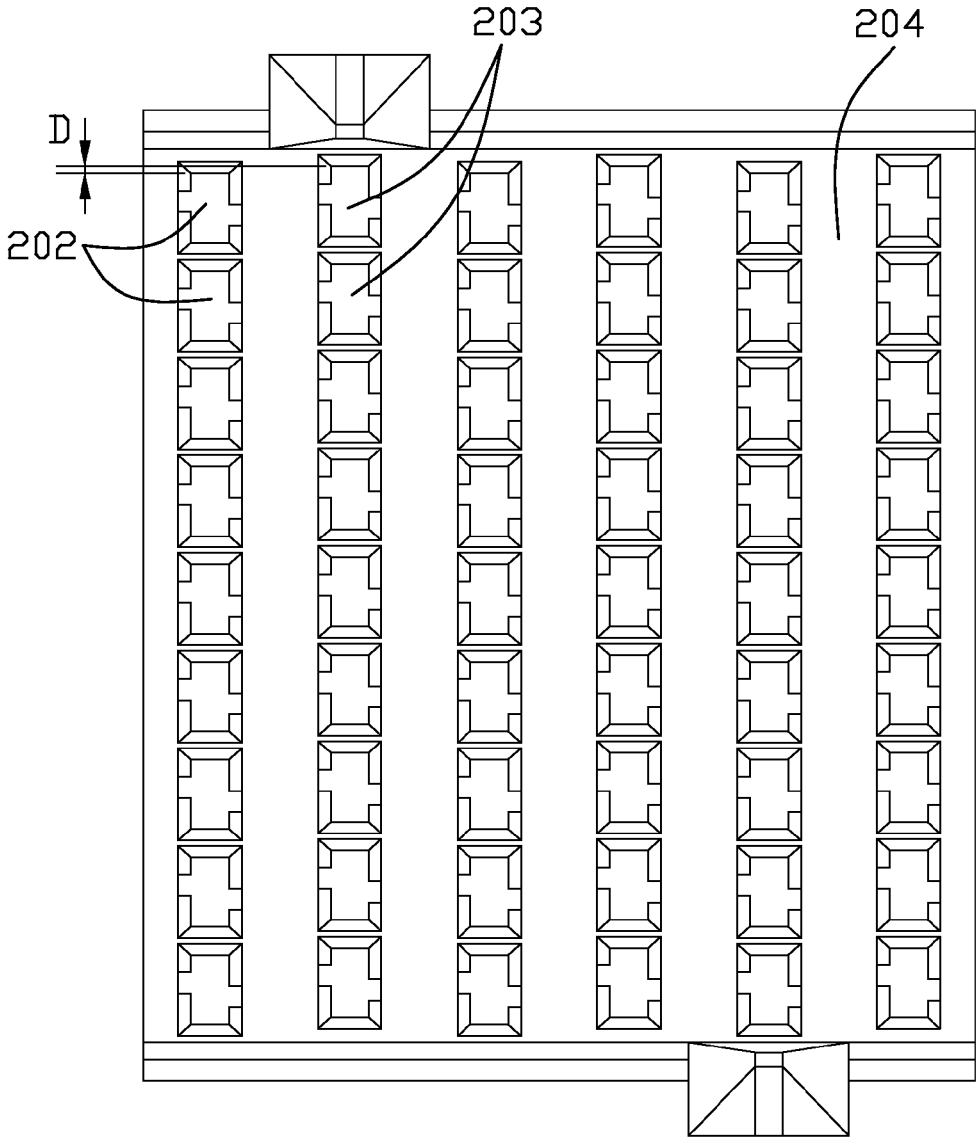
FIG. 5 is a front view of a front housing shown in FIG. 2.
Figure 6:
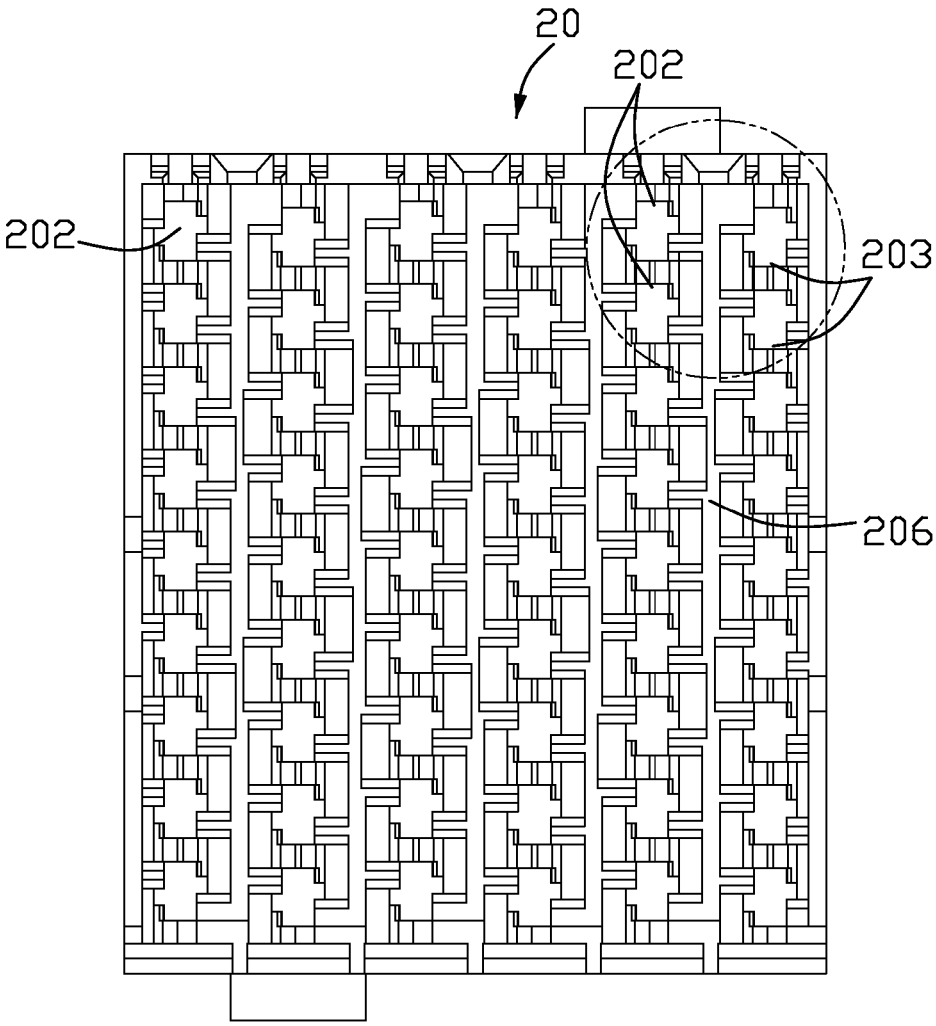
FIG. 6 is a back view of the front housing shown in FIG. 2.
Figure 7:
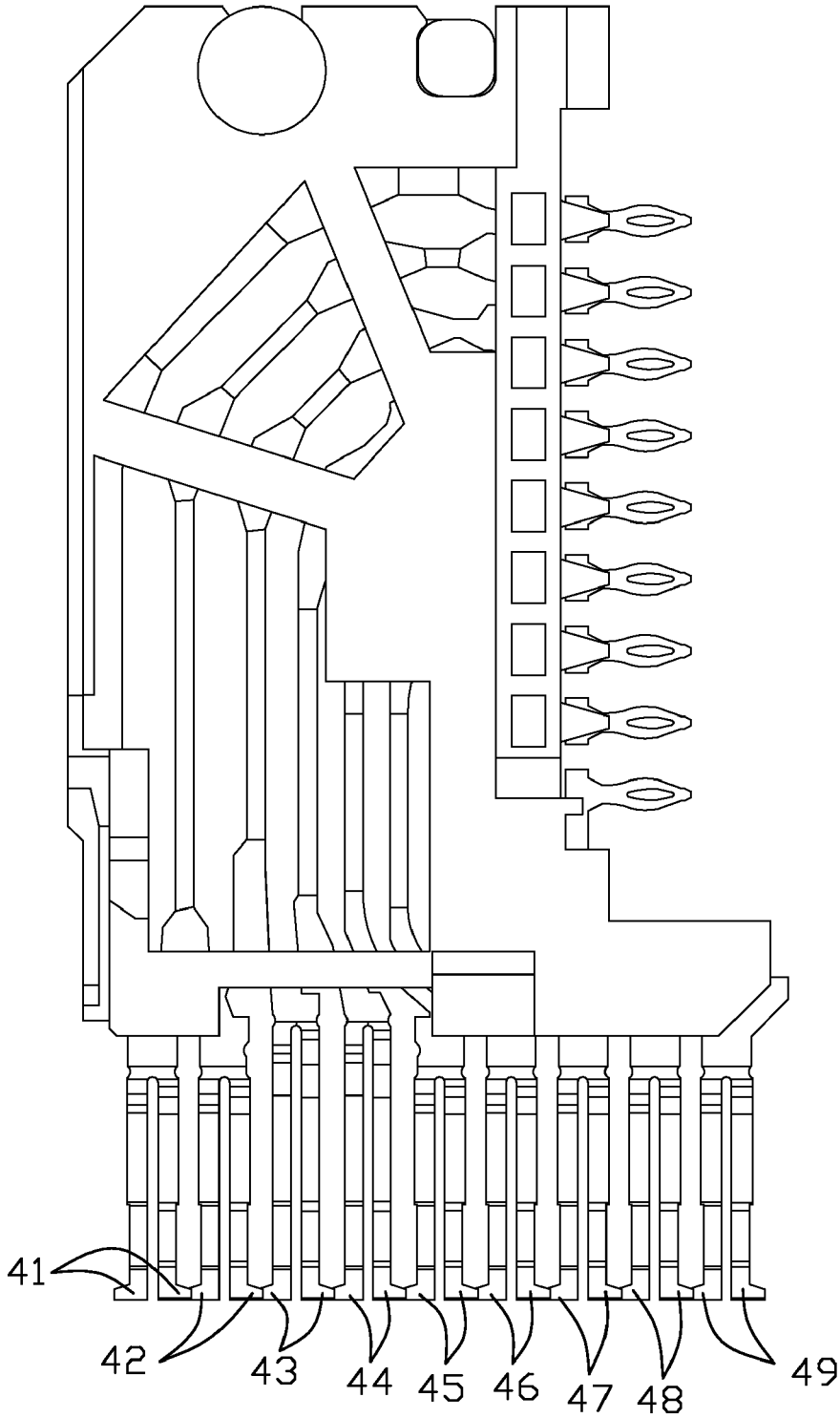
FIG. 7 is a side view of the wafers shown in FIG. 2, which shows each contact of each wafer are aligned with a corresponding contact of an adjacent wafer.

Referring to FIG. 2, the lead frame 34 of each wafer forms a front edge 346 and a notch or recessed portion 340 in the front edge 346. The mating portions 408 of the third and the fourth contacts 43, 44 of the wafer 40 extend forwardly from bottom of the notch 340 and the mating portions 408 of the other contacts 41, 42, 45-49 extending forwardly from the front edge 346 of the lead frame 34.

Referring to FIGS. 8 and 9, the first complementary mating connector 600 is shown. A first row of the mating contacts 641-649 is arranged with the fourth contact 644 having a longer length than the other contacts 641-643, 645-649. A second row of contacts 651-659 adjacent to the first row of mating contacts 641-649 is arranged with the third contact 653 having a longer length than the other contacts 641, 642, 644-649.

Figure 14:
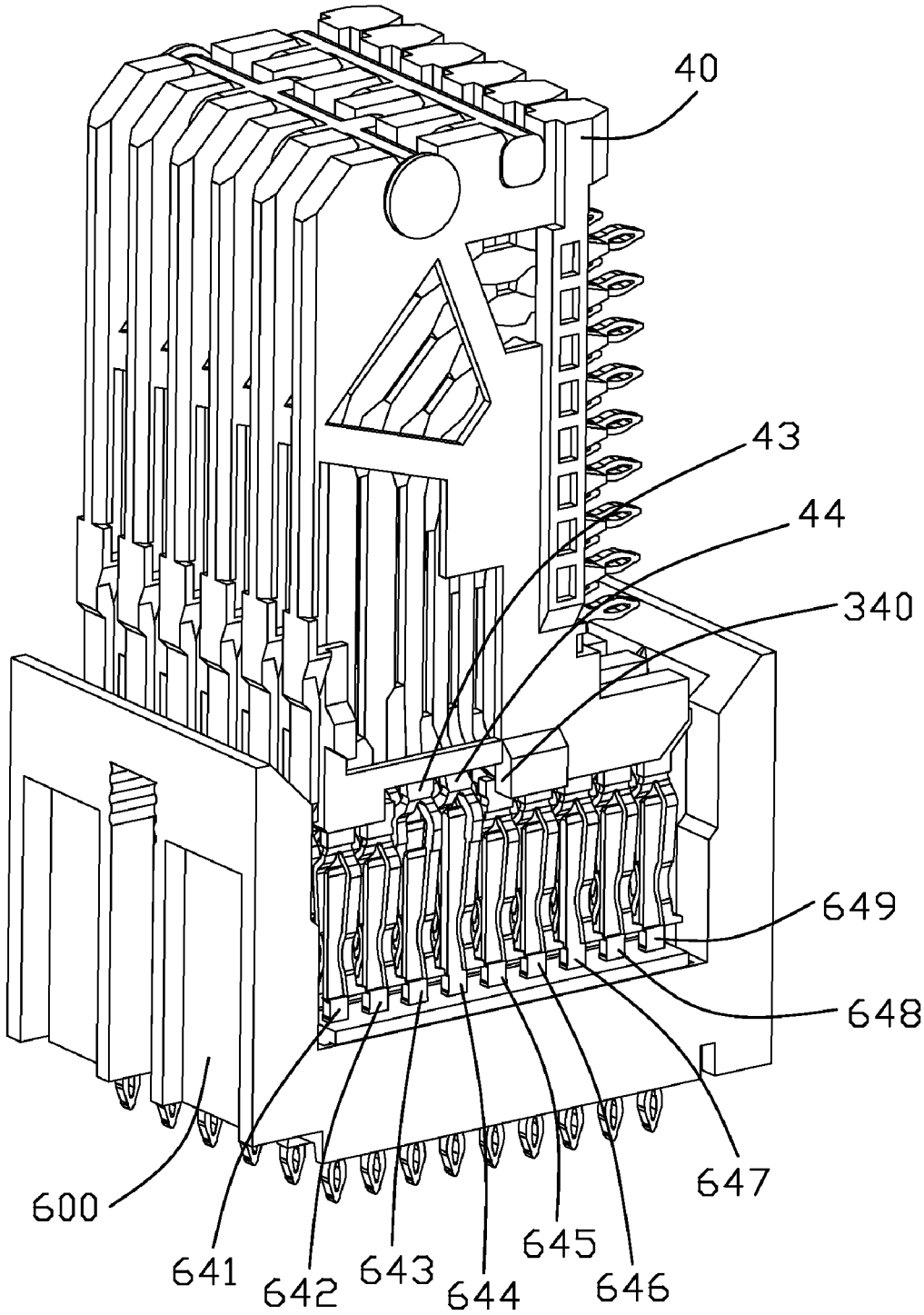
FIG. 14 is a perspective view showing the mating of the electrical connector and the complementary mating connector having non-offset contact array (the front housing is removed for more clearly shown)
Figure 15:
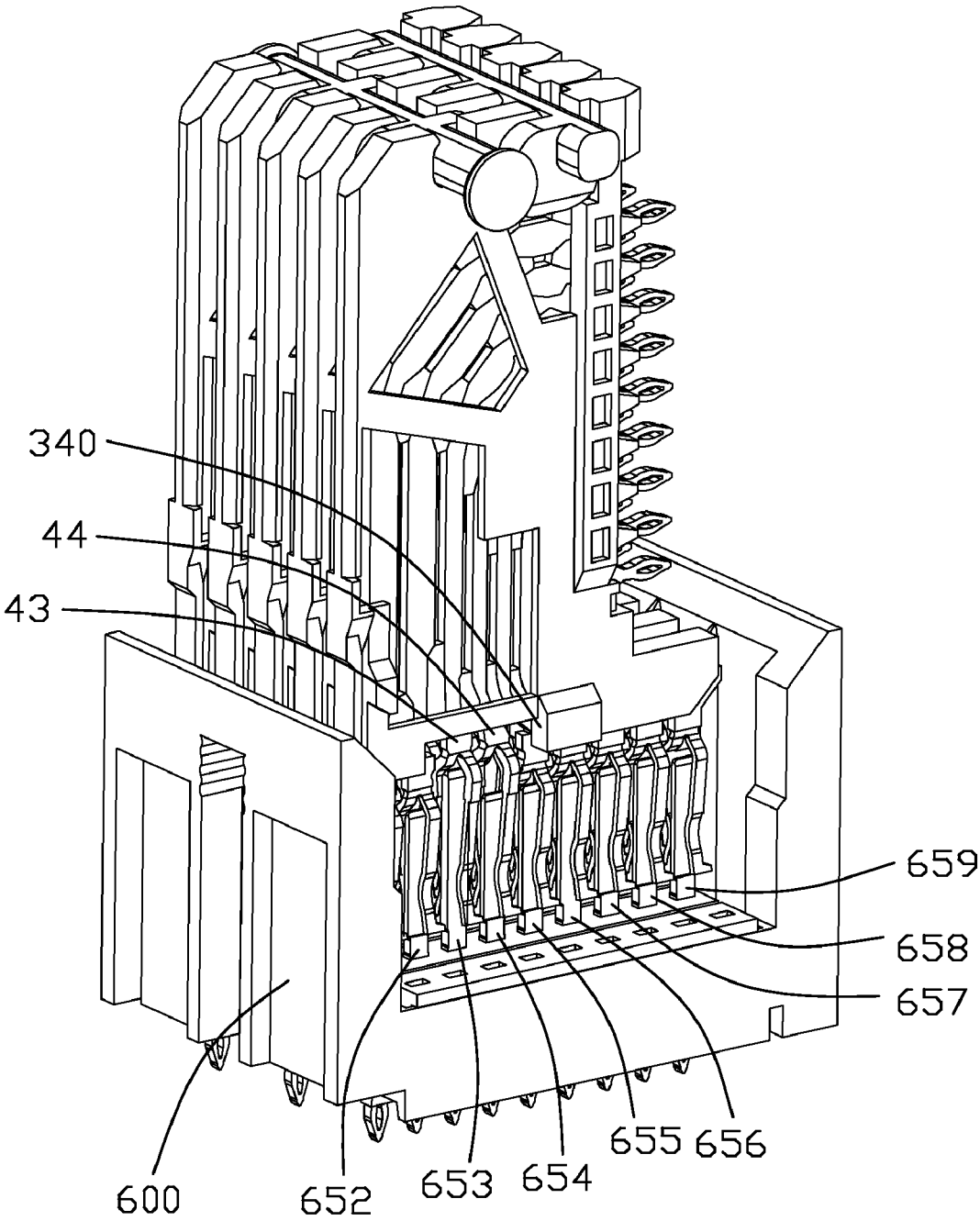
FIG. 15 is a perspective view showing the mating of the electrical connector and the complementary mating connector having non-offset contact array (the front housing and a wafer are removed for more clearly shown).

Referring to FIGS. 2, 14 and 15, each of the mating portions 408 of the contacts 41-49 of the wafer 40 has a pair of flexible beams 442. The mating portions 408 of the third and fourth contacts 43, 44 have longer flexible beams 442 comparing the mating portion 408 of other contacts 41, 42, 45-49 since the notch 346 is provided. The third and fourth contacts 43, 44 having longer flexible beams 442 could receive the third mating contact 644 or the fourth mating contact 653 which are longer, so that the wafer 40 could have the same configuration to mate with different contact row of the mating contacts 641-649, 651-659 of the mating connector 600.

Referring back to FIG. 2, the lead frame 34 is formed with a plurality of window portions 348 so that part of said fastening portion 404 is exposed in ambient air. The contacts 41-49 of the wafer 40 are arranged in a line with three signal contact pairs for transferring differential signals and a ground contact interposed between the adjacent contact pairs for shielding the adjacent signal contact pairs. The front housing 20 forms ten flexible latches 24 for fastening said lead frames 40. Each of the wafers 40 has the same configuration, so that all the wafers could be made in a same set of molds. Each of the wafers 40 defines two notch 342 aligned to each other which forms two slots. Two fixing rods 80 are inserted to said slots and then fasten said wafers 40 in position.

The disclosure is illustrative only, changes may be made in detail, especially in matter of shape, size, and arrangement of parts within the principles of the invention.

What is claimed is:

1. An electrical connector to be mounted on a PCB comprising:

a front housing defining a front surface, an opposite back surface and a plurality of passageways extending from said back surface to said front surface, the passageways arranged in rows and columns;

a plurality of stacked wafers each comprising a lead frame and a plurality of conductive contacts molded in the lead frame, each of the contacts comprising a fastening portion molded in the lead frame, a mating portion extending from the fastening portion for mating with a complementary mating connector and a terminal portion extending from the fastening portion to be mounted in said PCB, said plurality of conductive contacts being arranged coplanarly;

wherein the mating portions of the contacts of a wafer are respectively inserted into a row of passageways;

wherein adjacent rows of passageways are arranged with an offset, and corresponding adjacent wafers are arranged with the contacts of adjacent wafers aligned in a direction perpendicular to said coplanar surface;

wherein each of the wafers has a same configuration.

2. An electrical connector as claimed in claim 1, wherein the lead frame is formed with a plurality of window portion so that part of said fastening portion is exposed to ambient air.

3. An electrical connector as claimed in claim 1, wherein the conductive contacts of the wafer are arranged in signal contact pairs for transferring differential signals and a ground contact interposed between adjacent contact pairs.

4. An electrical connector as claimed in claim 1, wherein the front housing forms a plurality of flexible latches for fastening said lead frames.

5. An electrical connector as claimed in claim 1, wherein each of the wafers defines a notch aligned to each other, a fixing rod inserted to said notches thereby fastening said wafers in position.

6. An electrical connector to be mounted on a PCB comprising:

a front housing defining a front surface, an opposite back surface and a plurality of passageways extending from said back surface to said front surface, the passageways arranged in rows and columns;

a plurality of stacked wafer, each of the wafers comprising a lead frame and a plurality of conductive contacts molded in the lead frame, each of the contacts comprising a fastening portion molded in the lead frame, a mating portion extending from an end of the fastening portion for mating with a complementary mating connector and a terminal portion extending from an opposite end to be mounted in said PCB, said plurality of conductive contacts being arranged on a coplanar surface;

wherein the mating portions of the contacts of a wafer are respectively inserted into a row of passageways;

wherein the lead frame of each wafer forms a front edge with a notch defined therein, the mating portions of two adjacent contacts of the wafer extending forwardly from a bottom of the notch and the mating portions of the other contacts extending forwardly from the front edge of the lead frame.

7. An electrical connector as claimed in claim 6, wherein each wafer has at least six contacts, in turn a first to a sixth contacts, and wherein the mating portions of the third and the fourth contacts are extending from said notch of the lead frame.

8. An electrical connector as claimed in claim 6, wherein each of the mating portions of the contacts of the wafer has a pair of flexible beams, the mating portions of said two adjacent contacts having longer flexible beams than the mating portions of other contacts.

9. An electrical connector as claimed in claim 6, wherein the lead frame is formed with a plurality of window portions so that part of said fastening portion is exposed in the ambient air.

10. An electrical connector as claimed in claim 6, wherein the contacts of the wafer are arranged in signal contact pairs for transferring differential signals and a ground contact interposed between adjacent said contact pairs for shield adjacent signal contact pairs.

11. An electrical connector as claimed in claim 6, wherein the front housing forms a plurality of flexible latches for fastening said lead frames.

12. An electrical connector as claimed in claim 6, wherein each of the wafers has the same configuration.

13. An electrical connector as claimed in claim 6, wherein each of the wafers defines a notch aligned to each other, a fixing rod being inserted to said notches thereby fastening said wafers in position.

14. An electrical interconnection system, comprising:

a receptacle connector defining a mating interface with a plurality of passageways arranged in array, wherein every two adjacent first and second passageways are offset from each other with a preset distance, such a first passageway has a highest point, while the second passageways has a lowest point;

a first plug connector having a first array of header contacts in which every two adjacent first and second header contacts are arranged offset corresponding to the offset arrangement of the passageways of the receptacle connector;

a second plug connector having a second array of header contacts in which every two adjacent third and fourth header contact are arranged in a same level;

wherein when the first plug connector is mated with the receptacle connector, the highest point and the lowest point of the passageways are substantially in contact with the first and second header contacts; and wherein when the second plug connector is mated with the receptacle connector, the highest point and lowest point of the passageways are not substantially in contact with the third and fourth header contacts.

15. An electrical interconnection system as claimed in claim 14, wherein when the second plug connector is mated with the receptacle connector, the highest point and lowest point of the passageways are at a preset distance from the third and fourth header contacts.

16. An electrical interconnection system as claimed in claim 14, wherein the first contact and the second contact are bigger than the third contact and the fourth contact in a direction perpendicular to an array direction.

17. An electrical interconnection system as claimed in claim 14, wherein said receptacle connector is equipped with an array of terminals respectively disposed in the corresponding passageways, for mating with the corresponding header contacts of the first plug or of the second plug connector, under condition that said terminals are essentially at the same level with the corresponding contacts of the second plug connector.

18. An electrical interconnection system as claimed in claim 17, wherein the passageway is larger than the corresponding terminal in a direction perpendicular to an array direction with a symmetrical manner.

19. An electrical interconnection system as claimed in claim 18, wherein said passageway is essentially compliant with a maximum dimension of the first array of contacts in the direction while the terminal is essentially compliant with a maximum dimension of the second array of contacts in the direction.

* * * * *